US006929153B1

(12) United States Patent
Gerich

(10) Patent No.: US 6,929,153 B1
(45) Date of Patent: Aug. 16, 2005

(54) FLUID DISPENSING APPARATUS WITH CHECK-VALVE OPERATED MIXING ABILITY

(76) Inventor: Horst Gerich, 17 Affonso Dr., Carson City, NV (US) 89706

( * ) Notice: Subject to any disclaimer, the term of this patent is extended or adjusted under 35 U.S.C. 154(b) by 0 days.

(21) Appl. No.: 10/392,648

(22) Filed: Mar. 19, 2003

(51) Int. Cl.[7] ..... B67D 5/00
(52) U.S. Cl. ..... 222/145.6; 222/135; 222/145.1
(58) Field of Search ..... 222/135–137, 222/145.1, 145.2, 145.5, 145.6; 137/607; 239/414

(56) References Cited

U.S. PATENT DOCUMENTS 3,251,508 A * 5/1966 Borys ..... 222/132
4,019,652 A * 4/1977 Suh et al. ..... 222/1
4,789,100 A * 12/1988 Senf ..... 239/61
5,127,547 A 7/1992 Gerich
5,332,125 A * 7/1994 Schmitkons et al. ..... 222/1
5,477,988 A 12/1995 Gerich
5,979,794 A * 11/1999 DeFillipi et al. ..... 239/135
6,564,971 B2 * 5/2003 Heyes ..... 222/129.1

* cited by examiner

*Primary Examiner*—J. Casimer Jacyna
(74) *Attorney, Agent, or Firm*—Blakely, Sokoloff, Taylor & Zafman LLP

(57) ABSTRACT

A fluid dispensing gun that features a cap with first and second inlets to receive separate, metered flows of fluid. The cap has a first duct that to direct flow from the first inlet to a first outlet. A check valve receives flow from the second inlet. The duct and the check valve are arranged to bring fluid flow from the first inlet into contact with fluid flow from the second inlet. The cap may be a separate, disposable piece, so that the gun need not be purged after each use.

37 Claims, 5 Drawing Sheets

FIG. 2
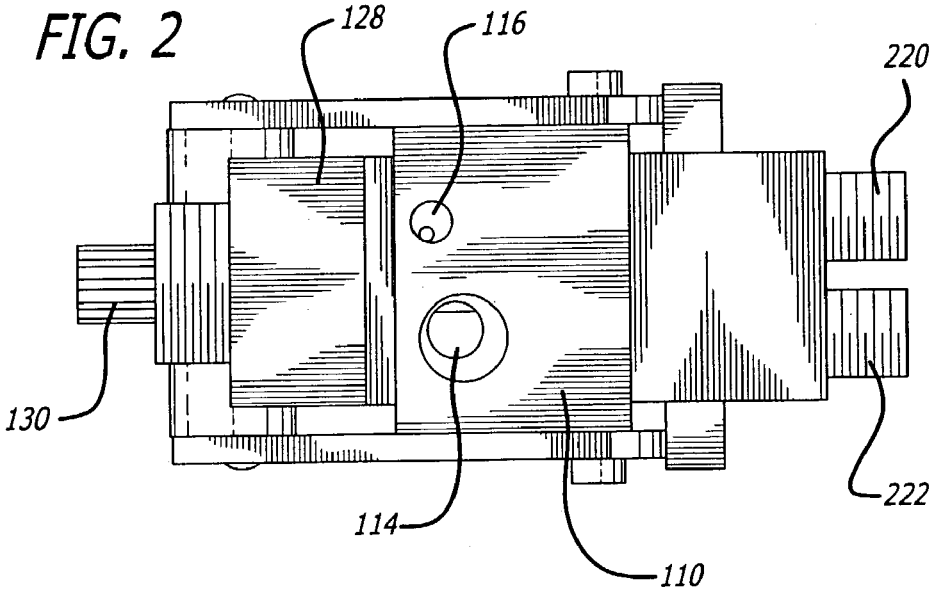
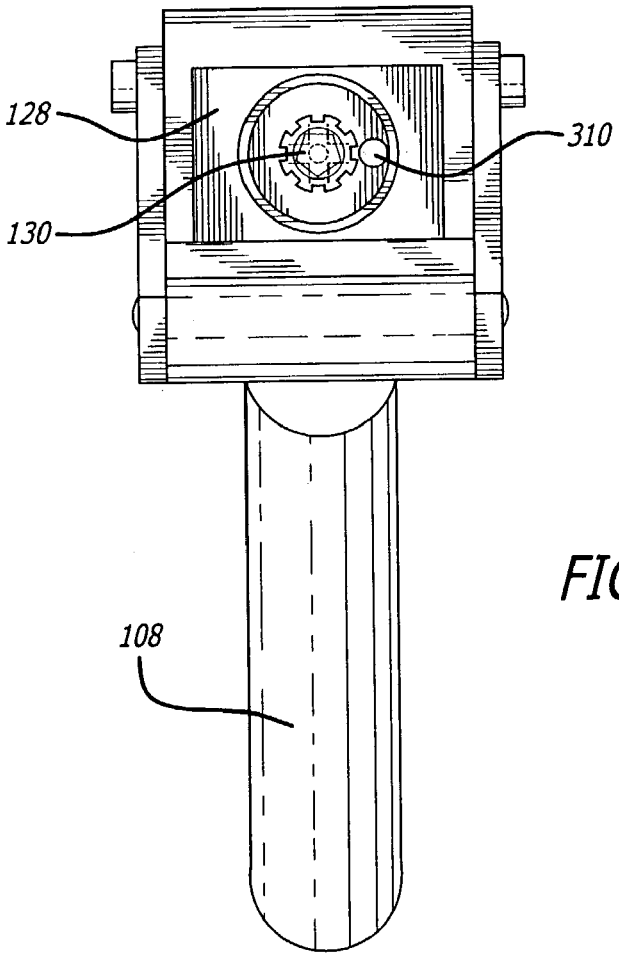
FIG. 3

FLUID DISPENSING APPARATUS WITH CHECK-VALVE OPERATED MIXING ABILITY

BACKGROUND

The invention is related to equipment used for continuously dispensing two or more fluids in a manner suitable for mixing them, which fluids then react to form, for example, a strong adhesive and/or sealant. More particularly, the invention is related to a dispensing apparatus designed to accurately dispense, for purposes of mixing, at least two reactive fluids that may flow at different pressures and/or have different viscosity.

The mixing of two or more fluids, for purposes of activating bonding and/or sealing properties of the mixture, has many applications. Some of these applications, such as bonding tiles or plates to the fuselage of aircraft or other vehicles in a volume manufacturing setting, require that at least two reactive flows be accurately metered and then mixed continuously. The mixture is applied to one or more of the surfaces that are to be bonded or sealed. In such an application, there may be a relatively thick, first fluid which may be referred to as the base material, that is to be mixed with a relatively thin, second fluid which may be referred to as the catalyst. These two disparate fluids are to be accurately and automatically metered and then mixed, continuously, to yield a desired flow amount of a desired mixture.

A dispensing gun can been used to receive accurately metered amounts of two flows, controllably provide the flows to a mixing structure, and then on to the surfaces to be sealed or bonded. See, e.g., U.S. Pat. Nos. 5,477,988 and 5,127,547 to Gerich. The ideal dispensing gun and metering apparatus should be able to provide a continuous flow of a mixture that has the correct proportions of the two reactive fluids, for as many different types of fluid viscosity and flow pressure. In some cases, the gun is purged after each use, so that no residual amounts of the two reactive fluids remain in contact within the gun (thereby making the gun, but not the mixing structure, essentially reusable).

SUMMARY

A problem has been discovered with the conventional dispensing gun in that, even if the two flows are accurately metered before being delivered to the dispensing gun, this "synchronization" is often lost when the flows emerge from the gun. In addition, if a dispensing gun has been designed to deliver one set of fluids for mixing, and is then redesigned (by changing a size of an orifice, for example) for another set of fluids to be mixed (e.g. having different viscosity than the first set), it is very difficult to re-calibrate the flows so that their mixture has the correct proportions.

According to an embodiment of the invention, a solution to this problem may lie in the use of a fluid dispensing gun that features a cap with first and second inlets to receive separate, metered flows of fluid. The cap has a first duct to direct flow from the first inlet to a first outlet. A check valve receives flow from the second inlet. The duct and the check valve are arranged to bring fluid flow from the first inlet into contact with fluid flow from the second inlet. The cap may be a separate, disposable piece, so that the gun need not be purged after each use. The check valve may help prevent flow of the first fluid back into a channel of the second fluid, when a flow of the first fluid is at a higher pressure than that of the second fluid, even when the design of the gun is changed for dispensing a different set of fluids.

Additional embodiments of the invention will be described below.

BRIEF DESCRIPTION OF THE DRAWINGS

The invention is illustrated by way of example and not by way of limitation in the figures of the accompanying drawings in which like references indicate similar elements. It should be noted that references to "an" embodiment of the invention in this disclosure are not necessarily to the same embodiment, and they mean at least one.

FIG. 2 illustrates a top plan view of the gun.

FIG. 3 depicts a front elevation view of the gun.

DETAILED DESCRIPTION

Figure 1:
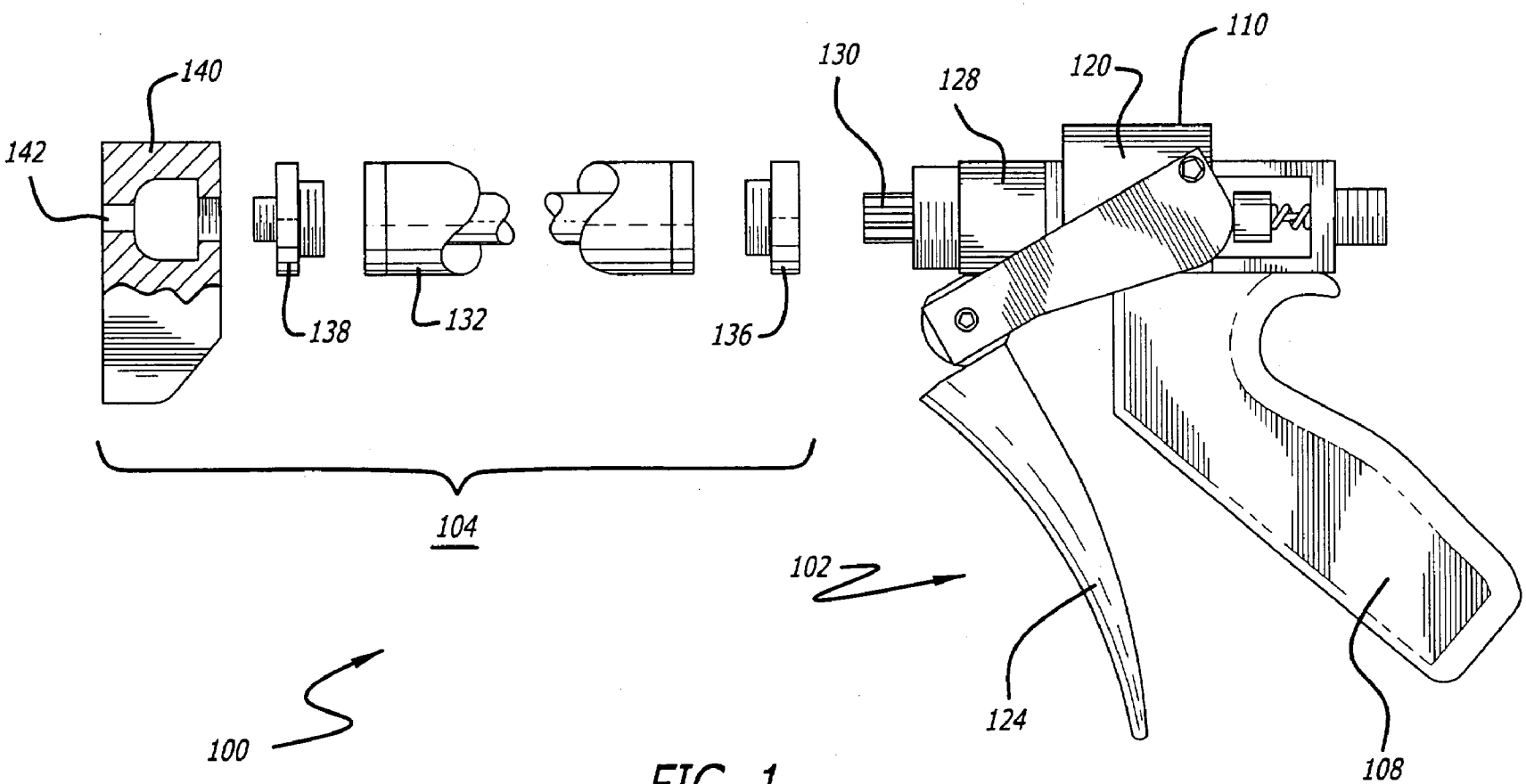
FIG. 1 shows an exploded, side elevation view of an embodiment of the invention being a dispensing gun assembly.

Beginning with FIG. 1, what is shown is an exploded, side elevation view of an embodiment of the invention as a dispensing gun assembly 100. The assembly 100 is composed of a gun 102 and a mixing and applicator assembly 104. The gun 102 will be described first. The gun 102 in this embodiment is a manually actuated, portable unit having a handle 108 that is located below and secured to a body assembly 110. The handle 108 allows a person to aim the gun assembly 100, and in particular its fluid mixture dispensing outlet (to be described below), to accurately deposit the mixture.

The body assembly 110 has first and second inlets 114, 116 positioned, in this embodiment, on a top face of the body assembly (see FIG. 2) to receive metered flows of two reactive fluids. A pair of valves 120 (not shown in FIG. 1, but to be described below in connection with FIGS. 4 and 5) serves to restrain and allow the two flows. A lever arm 124 is coupled to manually actuate the valves 120. The opening and closing action of the valves 120 may be adjustable, so that, for instance, they can open and close simultaneously as the lever arm is drawn, even with two flows having different viscosity and/or pressures. The adjustment may more generally be needed to calibrate the flows out of the valves according to a predetermined mixture ratio. For example, the adjustment may be needed to intentionally offset the opening (or closing) of the pair of valves as the lever arm 124 is drawn. The adjustment capability may be provided by an adjustable, valve stem biasing arrangement, such as the one described in U.S. Pat. No. 5,477,988.

The gun 102 further includes a cap 128, which is secured to the front of the body assembly 110 and receives the separate, metered flows from the valves 120. A first flow will emerge from the front of the cap, while a second flow emerges from a check valve 130 that is secured to the cap 128. The check valve 130 serves to direct the flows into contact with each other while preventing back flow of the second fluid. This helps keep the fluid of each channel in the valves 120 separate from the other. Otherwise, the valves 120 could be exposed to the reactive mixture if, for example, the first fluid flow was at a higher pressure and could flow into orifices and ducts normally exposed only to the second fluid flow.

Still referring to FIG. 1, the mixing and applicator assembly 104 in this embodiment is composed of a shroud-encased mixing structure 132 that is secured to the cap 128 via an adapter 136. The mixing structure 132 serves to thoroughly mix the flow of first and second fluids that have been brought into contact with each other at the cap, so the desired mixture can be formed. The structure 132 may consist of a mixing tube that slidably fits inside a shroud. The shroud containing the mixing tube may then be secured to the cap 128, e.g. via a thread mechanism. The shroud helps keep the structure 132 tightly coupled to the outlet of the cap 128, even in the presence of the high flow pressures mentioned below.

A spreading tool 140 may be coupled to the outlet of the mixing structure 132 via another adapter 138. The tool 140 serves to deliver the desired mixture to a surface to be treated. The desired mixture emerges under pressure from a face of the tool 140. A slot 142 is formed in the face, in a width direction of the tool 140, and fills up with the desired mixture while the face is pressed against the surface to be treated. The tool 140 may then be slid along the surface, to lay a strip of mixture that is as wide as the slot 142. The tool 140 may swivel with respect to the shroud and the mixing structure 132 so that it remains in contact with the surface while the gun is moved along at different angles. In some cases, the tool 140 may be replaced with an adapter (not shown) that allows a cartridge to be filled with the mixture.

Referring now to FIG. 2, what is shown there is a top plan view of the gun 102. The first inlet 114 is larger in this embodiment than the second inlet 116. Note also in this embodiment that the first and second inlets are located on a top face of the body assembly 110. An alternative here would be to locate the inlets 114, 116 on opposing sides of the body assembly 110, without of course interfering with the operation of the lever arm 124 (see FIG. 1). FIG. 2 also shows two movable spring housings 220, 222 extending back from the rear face of the body assembly 110, one for each of the pair of valves 120, used for adjusting the valve stem bias mentioned above.

Turning now to FIG. 3, this figure depicts a front elevation view of the gun 102. Note the positioning of the check valve 130 in this embodiment, i.e. substantially in the center of the front face of the cap 128. An outlet 310 is provided for the first fluid. An outlet for the second fluid, being through the check valve 130, is illustrated in FIG. 4.

Figure 4:
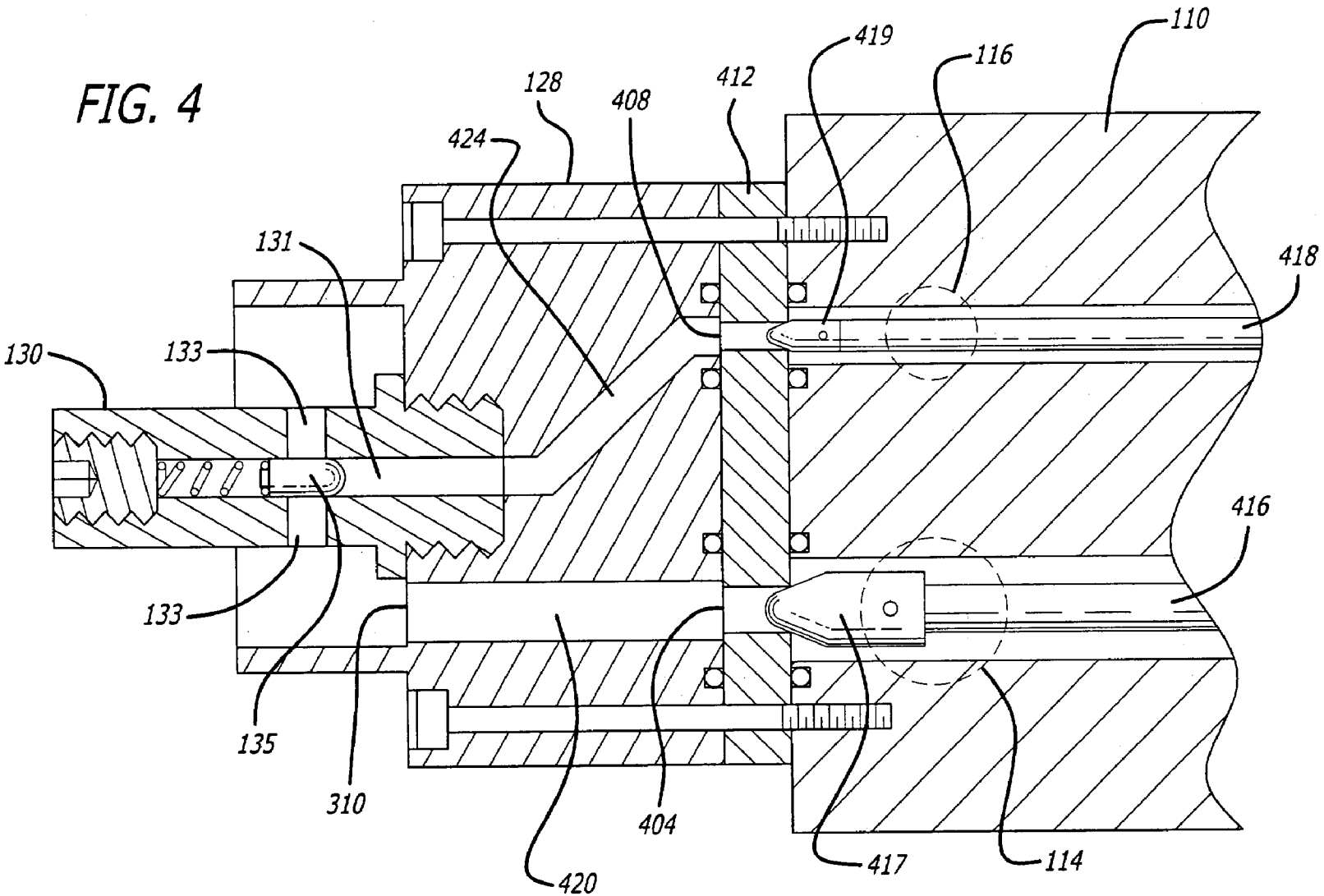
FIG. 4 shows a cross section of the body assembly and cap of the gun.

FIG. 4 shows a cross section of the body assembly 110 and the cap 128, as well as a portion of the valves 120 in some detail. See also FIG. 5, which depicts an exploded, isometric view of those same parts. The cap 128 has first and second inlets 404, 408 to receive separate, metered flows of fluid, via first and second outlets positioned on a front face of the body assembly 110. In this embodiment, a removable plate 412 is provided between the cap 128 and the body assembly 110 and on which the outlets and the valve seats of the pair of valves 120 are formed. This may render the gun 102 more serviceable, as the valve seats may be a greater wear item than other parts of the gun 102. FIG. 4 also shows the stems 416 and 418 of the valves 120. The stems 416, 418 are biased into the closed position shown, using springs (not shown) at the rear of the body assembly 110. Note how the larger stem 416 has a smaller diameter than its head 417. This design may help close the valve with a smaller spring, thereby rendering manual operation of the valves 120 less strenuous. Also, to help improve the sealing properties of the valves 120 in the presence of slight misalignment of the stem 416, 418, the heads 417, 419 may be "floating", e.g. via a pivoting attachment between the heads 417, 419 and the body of stems 416, 418. Seals, in particular O-rings, may be used between the cap 128 and the plate 412, and between the plate 412 and the main section of the body assembly 110, to prevent leaks of the first and second fluids. Additional details of such a valve can be found in U.S. Pat. No. 5,477,988.

Figure 5:
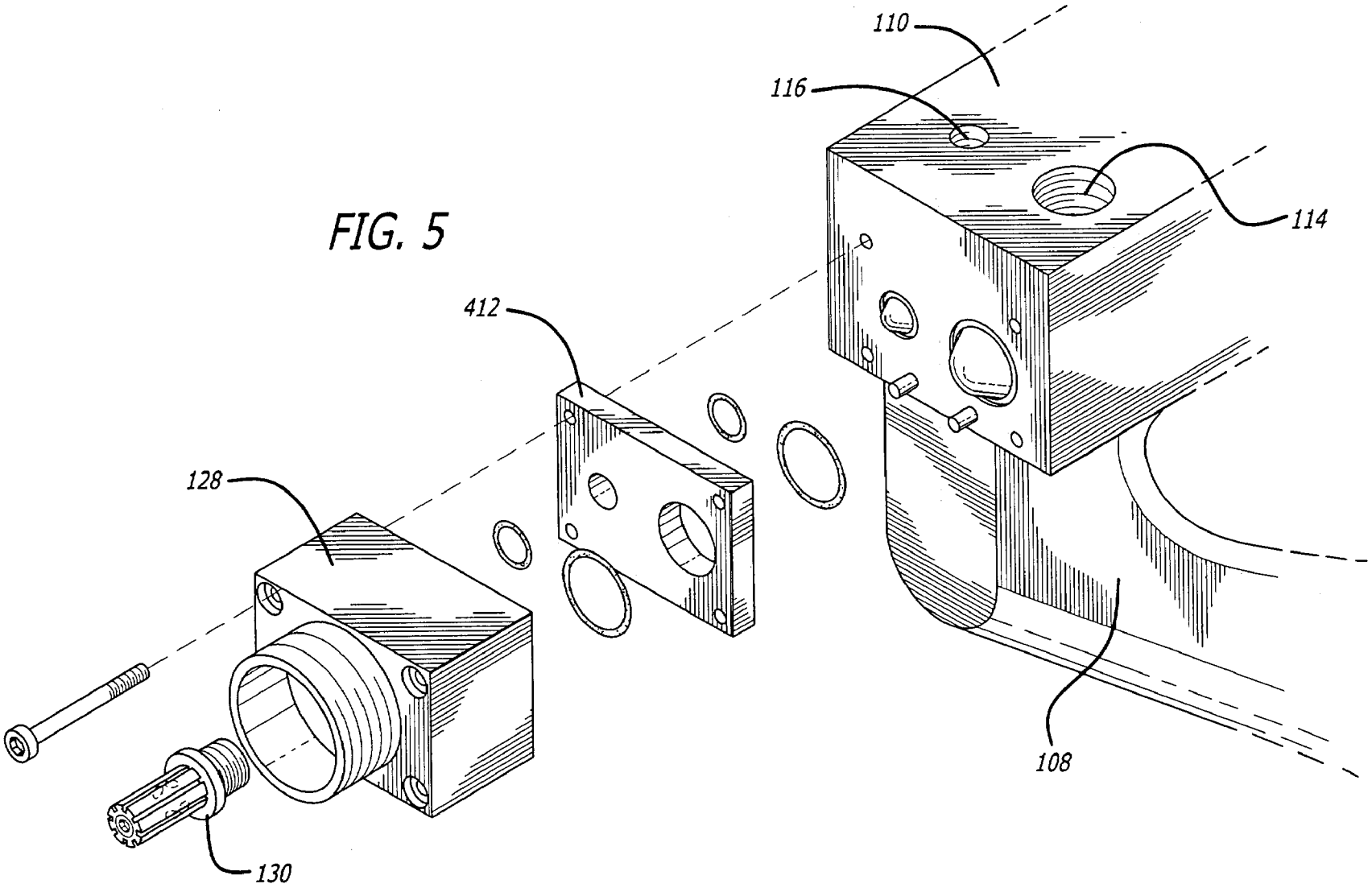
FIG. 5 illustrates an exploded, isometric view of the body assembly and cap.

FIGS. 4 and 5 also reveal the cap 128 in some detail. A first duct 420 in the cap 128 directs flow from the first inlet 404 to the outlet 310 (see FIG. 3). A second duct 424 directs flow from the second inlet 408 to another outlet of the cap 128 that feeds the check valve 130. So designed, the cap 128 and the check valve 130 may be separate, relatively low cost, disposable pieces. In this way, the gun assembly 100 need not provide a purging mechanism, which is typically used to purge one or both of the fluid channels of any residual amounts of the two fluids. Some type of purging is typically needed if the gun is to be re-useable following a long period of non-use, because otherwise the residue of the two fluids could come into contact with each other and thus react inside the gun assembly 100 thereby causing the gun to seize.

FIGS. 4 and 5 also show an embodiment of the check valve 130 in detail. The check valve 130 may be secured to the front face of the cap 128 to receive flow of the second fluid from the second inlet 408. In this embodiment, the check valve 130 has an elongated body with an inlet formed in an end of the body that is coupled to the outlet in the center of the cap 128. An elongated chamber 131 may extend to the inlet. At least one outlet 133 of the check valve 130 is formed in a side of the elongated body, and may further extend to the chamber 131. A spring-loaded piston 135 is disposed in the chamber 131 and is biased in a position that blocks flow through the one or more outlets. When the pressure in the inlet rises above a threshold level, the piston 135 is driven forwards, to the left of the figure, thereby allowing flow in the direction indicated. The check valve 130, and in particular its outlets 133, are arranged to direct flow from the first inlet 404 into contact with flow from the second inlet 408, in this case near the front most edge of the cap 128.

Note the check valve 130 may be coupled to the cap 128 by a threading mechanism and may be removable, so that different sizes of check valves may be used, depending upon the mixing application. For example, the length of the check valve 130, and therefore a location of its outlets in a longitudinal direction, that of fluid flow, may be predetermined during the design stage of the gun 102, as a function of expected pressures of the flows in the inlets 404, 408. If the pressure or viscosity of one or both flows is expected to be different, the gun 102 may be redesigned by changing the location of the check valve's outlets 133 accordingly, to compensate for the different flows and still dispense the two fluids in correct proportions.

Figure 6:
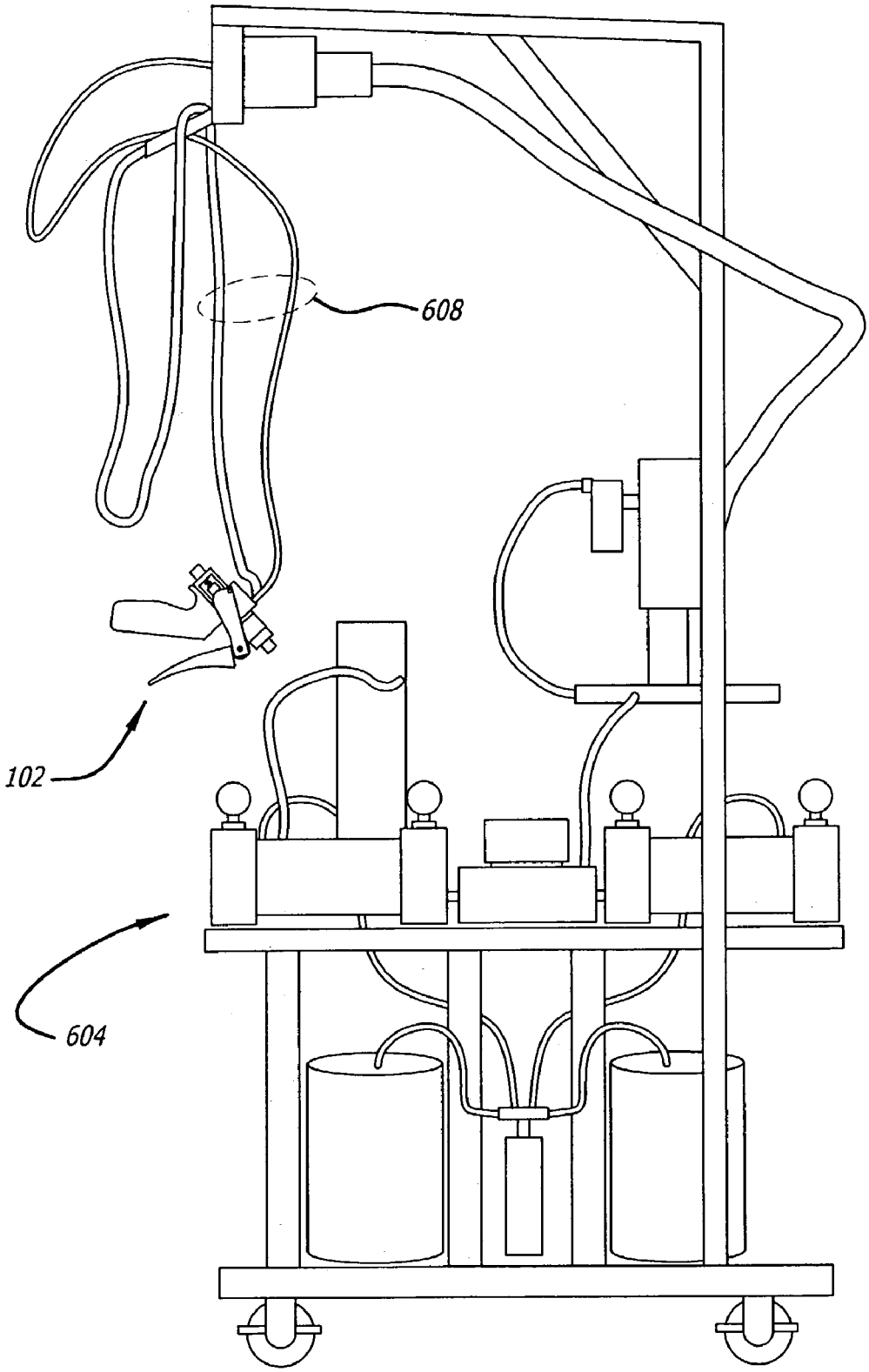
FIG. 6 depicts an automatic fluid metering and dispensing system.

The dispensing gun assembly 100 described above may be part of an automatic fluid metering and dispensing system 600, as shown in FIG. 6. An automatic metering mechanism 604 provides the metered flows of the first and second fluids to the dispensing gun assembly 100 via a pair of hoses 608. See U.S. Pat. No. 5,127,547 for an example of the metering mechanism 604. According to an embodiment of the invention, the metering mechanism 604 and gun assembly 100 are designed to work with a first fluid that is significantly thicker than the second fluid. Just as an example, the first fluid may be a base material having a viscosity in the range of that of tar, whereas the second fluid may be a catalyst whose viscosity is in the range of that of water or automobile motor oils. The proportions of the base material to the catalyst may also vary, for example from 12:1 to 5:1, and will be maintained at the output of the metering mechanism 604 automatically at pressures of, for example, in the range of 100 to 3000 psi, preferably greater than 1000 psi. The dispensing gun assembly 100 described above may further ensure such proportions, into and out of the mixing structure, to more closely meet the desired mixture. Note that designing the gun so that the base material flows through the larger outlet 310, and the catalyst flows through the one or more outlets 133, yields better early mixing, thereby advantageously enabling the use of a smaller (shorter) mixing tube.

Alternative Embodiments

Although the components of the gun assembly 100 may be designed to operate within the preferred range of fluid viscosity and flow pressures, as explained using examples above, the design of the gun assembly 100 and the metering mechanism 604 is not limited to fluids only in those ranges.

Also, the dispensing apparatus has been characterized as being made of a number of parts, such as the body assembly, plate, cap, and handle. In practice, at least some of these parts may be integrated (e.g., the handle may be machined out of the same piece of metal as the body assembly), for either manufacturing reasons or to lower the overall cost of producing the gun and/or operating it. Others such as adapters may not be needed at all.

Another alternative to the above-described embodiment of the gun assembly is the use of a powered actuation mechanism, e.g. pneumatic or electromechanical actuators, instead of the hand-powered lever arm. The powered actuation alternative might also be useful in robotic applications of the dispensing gun for very high volume manufacturing assembly lines.

Although the above description has focused on the dual channel embodiment of the invention, the invention may be used not just in binary mixing applications but also with applications that call for more than two fluids to be metered and mixed properly. In that case, the dispensing apparatus described above could be fitted with additional fluid channels.

To summarize, various embodiments of a fluid dispensing apparatus with check-value operated mixing ability have been described. In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A fluid dispensing apparatus comprising:

means for restraining and allowing flow of a first fluid, and means for restraining and allowing flow of a second fluid that is less viscous than the first;

means for receiving the flow of first and second fluids from the restraint and allow means;

means for bringing the received flow of first and second fluids into contact with each other while preventing back flow of the second fluid into the receiving means; and means for aiming a fluid dispensing outlet of the apparatus at a desired location;

means for manually actuating the restraint and allow means; and means for adjusting the manual actuation means.

2. The apparatus of claim 1 further comprising:

means for adjusting the restraint and allow means.

3. The apparatus of claim 1 further comprising:

means for mixing said flow of first and second fluids that have been brought into contact with each other.

4. The apparatus of claim 3 further comprising:

means for delivering said mixed flow of first and second fluids to a surface.

5. A fluid dispensing apparatus comprising:

a cap with first and second inlets to receive separate, metered flows of fluid, the cap having a first duct that directs flow from the first inlet to a first outlet, and a check valve to receive flow from the second inlet, wherein the first duct and the check valve are arranged to bring fluid flow from the first inlet into contact with fluid flow from the second inlet;

a body assembly having first and second valves that feed first and second outlets positioned on a front face of the assembly and to which the first and second inlets of the cap, respectively, are coupled; and a removable plate on which first and second valve seats for the first and second valves, respectively, are formed.

6. The apparatus of claim 5 wherein the cap further includes a second duct that directs flow from the second inlet to a second outlet of the cap, wherein the second outlet feeds the check valve.

7. The apparatus of claim 5 wherein the cap is a separate, disposable piece.

8. The apparatus of claim 5 wherein the body assembly has a top face and a pair of opposing side faces the body assembly further includes first and second inlets positioned on the top face and that feed the first and second valves, respectively.

9. The apparatus of claim 5 wherein the body assembly has a top face and a pair of opposing side faces the body assembly further includes a first inlet positioned on one of the side faces and a second inlet positioned on another one of the side faces and that feed the first and second valves, respectively.

10. The apparatus of claim 5 wherein the first and second valves have first and second valve stems with first and second floating heads, respectively.

11. The apparatus of claim 5 further comprising:

a handle coupled to the body assembly.

12. The apparatus of claim 6 wherein the check valve has an elongated body with (1) an inlet formed in an end of the elongated body being coupled to the second outlet, and (2) a plurality of outlets formed in a side of the elongated body.

13. The apparatus of claim 12 wherein the check valve is coupled to the second outlet in a removable manner.

14. The apparatus of claim 13 wherein the check valve is coupled to the second outlet by a threaded mechanism.

15. The apparatus of claim 12 wherein a length of the check valve has been predetermined as a function of expected pressures of the flows in the first and second inlets.

16. The apparatus of claim 6 wherein the check valve has an elongated chamber that extends to the inlet formed in the end of the elongated body, and the plurality of outlets extend to the chamber through the side of the elongated body.

17. The apparatus of claim 16 wherein the check valve further includes a spring-loaded cylinder disposed in the chamber and being biased in a position that blocks flow through the plurality of outlets.

18. The apparatus of claim 5 further comprising:

a delivery tool having an inlet to receive a mixed flow of said first and second fluids from the cap, and an outlet shaped as an elongated rectangle to deliver said mixed flow.

19. The apparatus of claim 5 further comprising:

a mixing tube having an inlet coupled to the cap, to mix said first and second fluids received from the cap.

20. The apparatus of claim 19 further comprising:

a shroud in which the mixing tube is inserted, the shroud having an outlet that is to receive said mixed flow from an outlet of the mixing tube, the shroud having an inlet end that is to be secured to the cap.

21. The apparatus of claim 20 further comprising:

an adapter to be threadingly coupled between the shroud and the cap.

22. The apparatus of claim 20 further comprising:

a delivery tool having an inlet to receive said mixed flow from the outlet of the shroud, and an outlet shaped as an elongated rectangle to deliver said mixed flow, the delivery tool being capable of swiveling with respect to the shroud.

23. A fluid metering and dispensing system, comprising:

a metering mechanism to provide metered flows of first and second fluids through first and second outlets, respectively; and a fluid dispensing apparatus having a check valve that directs fluid flow from the second outlet into contact with fluid flow from the first inlet wherein the check valve has an elongated body with (1) an inlet formed in an end of the elongated body that is coupled to the second outlet, and (2) a plurality of outlets formed in a side of the elongated body.

24. The system of claim 23 wherein the metering mechanism and the fluid dispensing apparatus are to operate with the first fluid having a greater viscosity than the second fluid.

25. The system of claim 24 wherein the metering mechanism and the fluid dispensing apparatus are to operate with the first fluid and the second fluid being part of an epoxy, silicone, polysulfide, and polyurethane.

26. The system of claim 24 wherein the metering mechanism and the fluid dispensing apparatus are to operate with the first fluid being a base and the second fluid being a catalyst that causes a reaction when mixed with the base.

27. The system of claim 26 wherein the metering mechanism and the fluid dispensing apparatus are to provide a mixture of the base and catalyst being one of an adhesive and a sealant.

28. The system of claim 24 wherein the metering mechanism is to provide said metered flows through the first and second outlets at more than 1000 psi.

29. The system of claim 24 wherein the fluid dispensing apparatus further includes a handle.

30. A fluid dispensing apparatus comprising:

a cap with first and second inlets to receive separate, flows of fluid, the cap having a first duct that directs flow from the first inlet to a first outlet, and a check valve to receive flow from the second inlet, wherein the first duct and the check valve are arranged to bring fluid flow from the first inlet into contact with fluid flow from the second inlet, wherein the cap further includes a second duct that directs flow from the second inlet to a second outlet of the cap, the second outlet feeds the check valve, and the check valve has an elongated body with (1) an inlet formed in an end of the elongated body being coupled to the second outlet, and (2) a plurality of outlets formed in a side of the elongated body.

31. The apparatus of claim 30 further comprising:

a body assembly having first and second valves that feed first and second outlets positioned on a front face of the assembly and to which the first and second inlets of the cap, respectively, are coupled.

32. The apparatus of claim 31 wherein the cap is a separate, disposable piece.

33. The apparatus of claim 31 further comprising a removable plate on which first and second valve seats for the first and second valves, respectively, are formed.

34. The apparatus of claim 31 wherein the first and second valves have first and second valve stems with first and second floating heads, respectively.

35. A fluid dispensing apparatus comprising:

a cap with first and second inlets to receive separate, flows of fluid, the cap having a first duct that directs flow from the first inlet to a first outlet, and a check valve to receive flow from the second inlet, wherein the first duct and the check valve are arranged to bring fluid flow from the first inlet into contact with fluid flow from the second inlet, wherein the cap further includes a second duct that directs flow from the second inlet to a second outlet of the cap, the second outlet feeds the check valve, and the check valve has an elongated chamber that extends to an inlet formed in an end of an elongated body, and a plurality of outlets extend to the chamber through a side of the elongated body.

36. The apparatus of claim 35 wherein the check valve further includes a spring-loaded cylinder disposed in the chamber and being biased in a position that blocks flow through the plurality of outlets.

37. The apparatus of claim 35 further comprising:

a body assembly having first and second valves that feed first and second outlets positioned on a front face of the assembly and to which the first and second inlets of the cap, respectively, are coupled, and wherein the cap is a separate, disposable piece.

* * * * *

UNITED STATES PATENT AND TRADEMARK OFFICE

CERTIFICATE OF CORRECTION

PATENT NO. : 6,929,153 B1
APPLICATION NO. : 10/392648
DATED : August 16, 2005
INVENTOR(S) : Gerich It is certified that error appears in the above-identified patent and that said Letters Patent is hereby corrected as shown below:

In Col. 5, Claim 1, Line 10, delete “and”.

Signed and Sealed this

Eleventh Day of September, 2007

JON W. DUDAS
*Director of the United States Patent and Trademark Office*